US006787981B2

(12) United States Patent
Yoo et al.

(10) Patent No.: US 6,787,981 B2
(45) Date of Patent: Sep. 7, 2004

(54) FLAT TYPE LAMP AND LIQUID CRYSTAL DISPLAY APPARATUS HAVING THE SAME

(75) Inventors: Hyeong-Suk Yoo, Seongnam-si (KR); Sung-Chul Kang, Seongnam-si (KR); Weon-Sik Oh, Osan-si (KR)

(73) Assignee: Samsung Electronics Co., Ltd. (JP)

( * ) Notice: Subject to any disclaimer, the term of this patent is extended or adjusted under 35 U.S.C. 154(b) by 0 days.

(21) Appl. No.: 10/213,688

(22) Filed: Aug. 7, 2002

(65) Prior Publication Data

US 2003/0132711 A1 Jul. 17, 2003

(30) Foreign Application Priority Data

Jan. 16, 2002 (KR) ..... 2002-2579

(51) Int. Cl.[7] ..... H01J 63/04

(52) U.S. Cl. ..... 313/491; 313/493; 313/495; 313/631; 313/634; 313/485; 313/574; 313/584

(58) Field of Search ..... 313/493–495, 313/631, 634, 491, 574, 586, 584, 483–485, 238–240, 609, 610; 362/222, 225, 561, 559

(56) References Cited

U.S. PATENT DOCUMENTS 4,920,298 A * 4/1990 Hinotani et al. ..... 313/493
4,978,888 A * 12/1990 Anandan et al. ..... 315/58
5,461,279 A * 10/1995 Hasegawa ..... 313/493
6,034,470 A * 3/2000 Vollkommer et al. ..... 313/485
6,255,782 B1 * 7/2001 Kuroda et al. ..... 315/169.1

FOREIGN PATENT DOCUMENTS

KR 2001000942 A * 1/2001 ..... H01J/61/78

* cited by examiner

*Primary Examiner*—Nimeshkumar D. Patel
*Assistant Examiner*—Sikha Roy
(74) *Attorney, Agent, or Firm*—Cantor Colburn LLP

(57) ABSTRACT

Disclosed is a flat type fluorescent lamp having a discharge space divided into a plurality of discharge areas. The flat type fluorescent lamp includes a first substrate, a second substrate separated from the first substrate in a predetermined distance to provide a discharge space containing a discharge material, first and second electrodes for applying a voltage to the discharge space and being disposed on the second substrate, and a sealing member for sealing side portions of the first and second substrates to isolate the discharge space from a peripheral space thereof. A plurality of barrier ribs having a slender shape are disposed in the discharge space and perpendicular to the first and second electrodes to divide the discharge space into a plurality of discharge areas. Accordingly, plasma converted from the discharge material has a uniform density through out the discharge space, thereby increasing brightness and uniformity of a light to be supplied to a display panel.

24 Claims, 5 Drawing Sheets

FLAT TYPE LAMP AND LIQUID CRYSTAL DISPLAY APPARATUS HAVING THE SAME

BACKGROUND OF THE INVENTION

1. Field of the Invention

The present invention relates to a liquid crystal display apparatus, and more particularly to a flat type fluorescent lamp capable of enhancing a brightness uniformity and a liquid crystal display apparatus having the same.

2. Description of Related Art

A display apparatus that is suitable with a new technical trend and is required for processing information has been developed to have a variety of shapes and functions and increased information processing speed. Particularly, a flat panel type display apparatus has been applied to a variety of electronic devices due to its features such as light weight, compact size and low power consumption, etc. An LCD (Liquid Crystal Display) apparatus among the flat panel type display apparatuses provides a full color and a high resolution in comparison with a display device such as a CRT (Cathode Ray Tube). Thus, the LCD apparatus has been widely used as display devices.

However, the LCD apparatus is a light-receiving element that cannot emit a light by itself, so that the LCD apparatus requires a light source and an image quality thereof is greatly affected by the light source. The light source is classified into a reflection type that uses an ambient light and a transmission type that uses a backlight. To display an image with high quality, the backlight method in which the light source is disposed at a rear of the LCD panel is widely used. An EL (Electro Luminescence), an LED (Light Emitting Diode), a CCFL (Cold Cathode Fluorescent Lamp) and a HCFL (Hot Cathode Fluorescent Lamp), etc., are used as the light source in the backlight method. The CCFL is advantageous in its long life expectancy, thin thickness and low power consumption, and the like, thus it is used in a TFT-LCD (Thin Film Transistor Liquid Crystal Display).

The CCFL is disposed either as a directly lighting type in which lamps are disposed under the LCD panel or as an edge lighting type in which lamps are disposed adjacent to side portions of a light guide plate. However, where the CCFL is disposed as the edge lighting type, there is a limitation in increasing brightness of the light and where the CCFL is disposed as the directly lighting type, thickness of the LCD apparatus can be increased, and uniformity of the brightness can be deteriorated.

Thus, a flat type fluorescent lamp is widely used as the light source to increase the brightness of the light and to obtain the uniformity of the brightness. The flat type fluorescent lamp is classified into an opposite electrodes disposing type and a surface discharging type.

FIG. 1 is a cross-sectional view showing a conventional flat type fluorescent lamp for the surface discharging type. FIG. 2 is a plan view showing a structure of the flat type fluorescent lamp shown in FIG. 1. Specifically, FIG. 1 is an enlarged view of A in FIG.2.

Referring to FIGS. 1 and 2, the flat type fluorescent lamp 90 includes a first substrate 10, a second substrate 20 separated from the first substrate 10 in a predetermined distance to provide a discharge space 40 between the first and second substrates 10 and 20, a plurality of spacers 30 disposed between the first and second substrates 10 and 20 for supporting the first substrate 10, and a sealing member (not shown) for sealing a side portion of the first and second substrates 10 and 20 to isolate the discharge space 40 from a peripheral space thereof. The second substrate 20 is positioned parallel to the first substrate 10. Also, the flat type fluorescent lamp 90 includes an insulating layer 22 and an electrode protection layer 24.

The first and second substrates 10 and 20 are made of a glass,. A fluorescent layer 12 is formed on a lower surface of the first substrate 10, and a pair of linear electrodes 26 for applying a high voltage to a discharge gas contained in the discharge space are formed on an upper surface of the second substrate 20. The fluorescent layer 12 is formed using green, blue and red phosphors and an organic resin. The linear electrodes 26 include a cathode 26*a* and an anode 26*b* separated from the cathode 26*a* in a predetermined distance, so that a discharging occurs between the cathode 26*a* and anode 26*b*.

Since a pressure inside the discharge space 40 is lower than an atmospheric pressure, if the size of the flat type fluorescent lamp 90 becomes larger, the first substrate 10 is sagged down or may be broken. The spacers 30 support the first substrate 10, thereby preventing the first substrate 20 from being sagged toward the second substrate 20. When a high voltage is applied to the flat type fluorescent lamp, the discharge gas charged in the discharge space 40 is excited and changed into a plasma. An ultraviolet ray is generated during the phase changing, and reacts with the fluorescent layer 12 to generate a visible ray.

However, there is no region into which an electric charge can be constitutively concentrated between the cathode and anode electrodes 26*a* and 26*b* in the flat type fluorescent lamp 90. Thus, a density of the plasma is randomly changed in the discharge space positioned between the cathode and anode electrodes 26*a* and *b*, which causes an irregular flow of the plasma. As a result, the ultraviolet ray, and the visible ray are irregularly formed, thus the brightness of the light emitted from the fluorescent lamp is not uniform, so that the display quality of the LCD apparatus adopting the conventional flat type fluorescent lamp is lowered.

BRIEF SUMMARY OF THE INVENTION

The present invention provides a flat type fluorescent lamp capable of uniformly generating a light.

The present invention also provides an LCD apparatus capable of increasing brightness and efficiency of the light.

In one aspect of the invention, there is provided a flat type fluorescent lamp comprising: a first substrate having a first fluorescent layer; a second substrate disposed parallel with the first substrate; a discharge space formed between the first and second substrates and containing a discharge material; an electrode part having first and second electrodes parallel to each other for applying a voltage to the discharge space, the first and second electrodes being disposed on the second substrate; and a plurality of barrier ribs disposed in the discharge space, the plurality of barrier ribs being perpendicular to the first and second electrodes and lower and upper surfaces of the plurality of barrier ribs respectively contacting an upper surface of the second substrate and a lower surface of the first substrate, to divide the discharge space into a plurality of discharge areas.

In another aspect, there is provided an LCD apparatus comprising: a backlight assembly for generating a light; a display unit for receiving the light emitted from the backlight assembly and controlling a liquid crystal to display an image; and a receiving container for sequentially receiving the backlight assembly and display unit, wherein the backlight assembly includes a flat type lamp having a first substrate having a first fluorescent layer; a second substrate disposed parallel with the first substrate; a discharge space formed between the first and second substrates and containing a discharge material; an electrode part having first and second electrodes parallel to each other for applying a voltage to the discharge space, the first and second electrodes being disposed on the second substrate; and a plurality of barrier ribs disposed in the discharge space, the plurality of barrier ribs being perpendicular to the first and second electrodes and lower and upper surfaces of the plurality of barrier ribs respectively contacting an upper surface of the second substrate and a lower surface of the first substrate, to divide the discharge space into a plurality of discharge areas.

According to the present invention, plasma converted from the discharge material contained in the discharge space has a uniform density. Also, the barrier ribs can be integrally formed with the first substrate, thereby maintaining uniformity of brightness of the flat type fluorescent lamp in a desirable level and removing a shadow portion which may be caused by an adhesive to fixing the barrier ribs to the first substrate.

BRIEF DESCRIPTION OF THE DRAWINGS

The above and other advantages of the present invention will become readily apparent by the following detailed description with reference to the accompanying drawings in which.

DETAILED DESCRIPTION OF THE INVENTION

Figure 1:
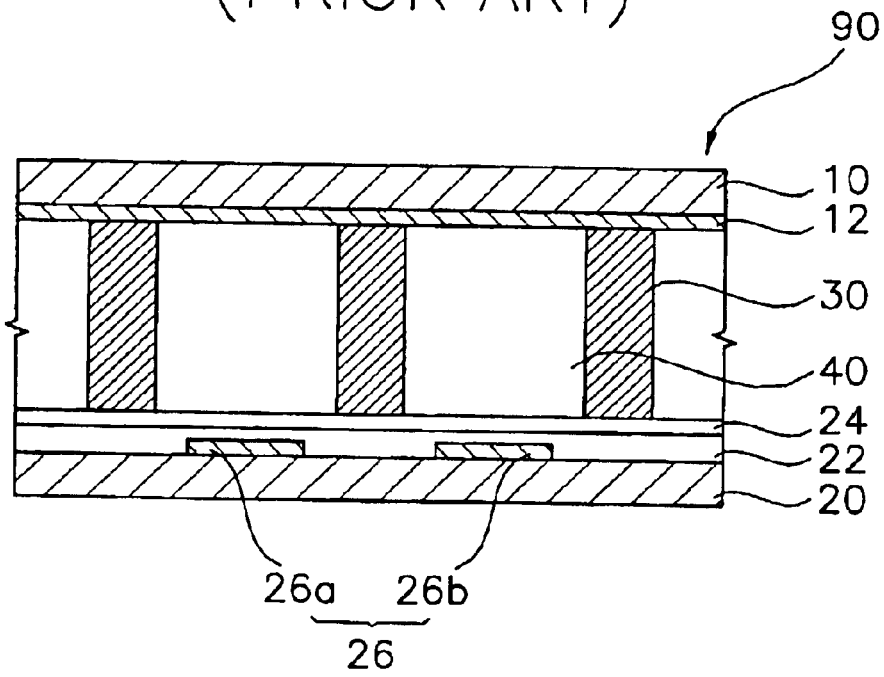
FIG. 1 (PRIOR ART)
FIG. 1 is a cross-sectional view showing a conventional flat type fluorescent lamp for the surface discharging type.
Figure 2:
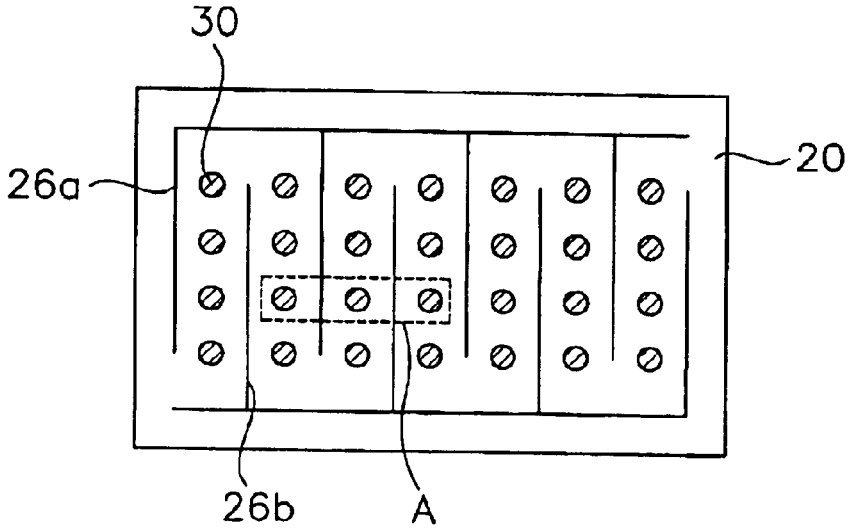
FIG. 2 (PRIOR ART)
FIG. 2 is a plan view showing a structure of the flat type fluorescent lamp shown in FIG. 1.
Figure 3:
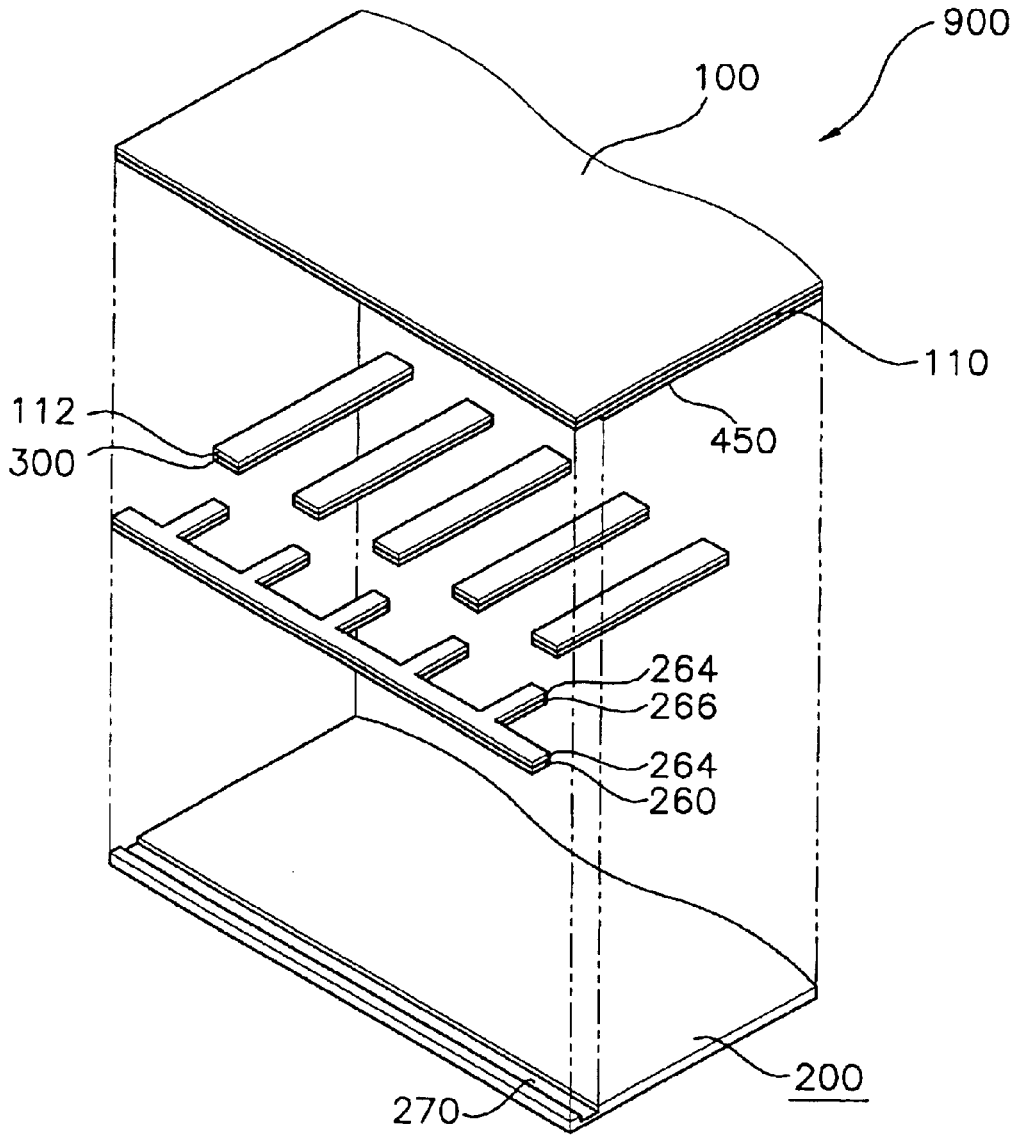
FIG. 3 is an exploded perspective view showing a structure of a flat type fluorescent lamp according to a first embodiment of the present invention.
Figure 4:
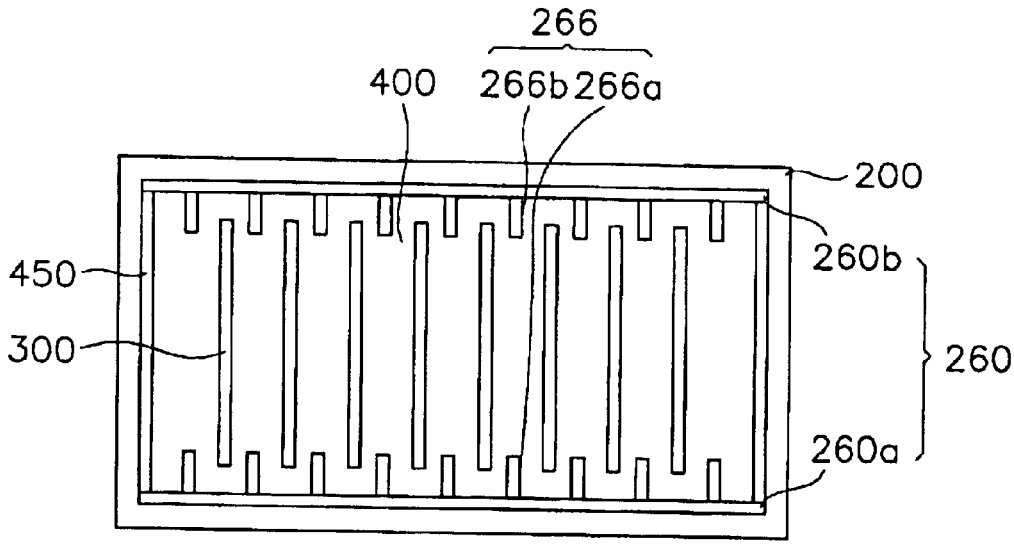
FIG. 4 is a plan view showing a structure of barrier ribs and electrodes of the flat type fluorescent lamp shown in FIG. 3.

FIG. 3 is an exploded perspective view showing a structure of a flat type fluorescent lamp according to a first embodiment of the present invention. FIG. 4 is a plan view showing a structure of barrier ribs and electrodes of the flat type fluorescent lamp shown in FIG. 3.

Referring to FIGS. 3 and 4, the flat type fluorescent lamp 900 includes a first substrate 100, a second substrate 200 and a discharge space 400 between the first and second substrates 100 and 200. A plurality of barrier ribs 300 are disposed in the discharge space 400 and lower and upper surfaces thereof contact the first and second substrates 100 and 200. The flat type fluorescent lamp 900 further includes a sealing member 450 for sealing side portions of the first and second substrates 100 and 200 and the discharge space is maintained in a vacuum state.

The first and second substrates 100 and 200 are made of a transparent material such as a glass capable of transmitting light. The first and second substrates 100 and 200 can have various forms depending on an intended purpose of the flat type fluorescent lamp 900.

The first substrate 100 includes a first fluorescent layer 110 on a lower surface thereof. The first fluorescent layer 110 reacts with an ultraviolet ray to generate a visible ray. The first fluorescent layer 110 can be formed by various methods. Generally, a material which reacts with ultraviolet ray to generate a visible ray is used for the fluorescent layer. Each of green, blue and red phosphors is mixed with an organic resin and deposited on the substrate to form the fluorescent layer. The first fluorescent layer 110 may further include a metal-oxide, and the metal oxide increases emission of a secondary electron, thus lowers a discharge. The first fluorescent layer 110 may further include a substrate protection layer (not shown) on a lower surface of the first fluorescent layer 110. The protection layer prevents infiltration of components of a discharge gas, thereby preventing a light efficiency and brightness uniformity from being lowered. The substrate protection layer includes particles such as a glass powder to maintain a transparency of the substrate protection layer, thereby easily transmitting and scattering the ultraviolet ray.

The second substrate 200 includes an electrode 260 having an anode electrode 260*a* and a cathode electrode 260*b*. The anode electrode 260*a* and the cathode electrode 260*b* are disposed along opposing edge portions of an upper surface of the second substrate 200 and the anode and cathode electrodes 260*a* and 260*b* are parallel with each other. The anode electrode 260*a* is inserted into a first electrode insertion groove 270 in the upper surface of the second substrate 200. The first electrode insertion groove 270 has a depth less than a thickness of the anode electrode 260*a*. Thus, when the anode electrode 260*a* is inserted into the first electrode insertion groove 270, an upper portion of the anode electrode 260*a* is protruded out of the upper surface of the second substrate 200. Similarly, a second electrode insertion groove (not shown) is in the upper surface of the second substrate 200 corresponding to the first electrode groove 270. The cathode electrode 260*b* is inserted into the second electrode insertion groove (not shown) and an upper portion of the cathode electrode 260*b* is protruded out of the upper surface of the second substrate 200. The electrodes 260*a* and 260*b* are made of a conductive material and include an electrode protection layer 264 on upper surfaces thereof. The electrode protection layer 264 protects the electrodes 260*a* and 260*b* and reflects the visible ray radiated to the second substrate 200, thereby increasing the light efficiency. The electrode protection layer 264 is made of a dielectric material. Namely, a dielectric layer 264 is formed on the upper surfaces of the electrodes 260*a* and 260*b*. The electrode protection layer 264 made of a dielectric material can enhance the discharging ability of the electrodes.

To improve the discharge efficiency in the discharge space, the anode electrode 260*a* includes a plurality of anode protrusion portions 266*a* extended from the anode electrode 260*a* toward the cathode electrode 260*b* and the cathode electrode 260*b* includes a plurality of cathode protrusion portions 266*b* extended from the cathode electrode 260*b* toward the anode electrode 260*a*. The anode protrusion portions 266*a* are parallel with each other, the cathode protrusion portions 266*b* are parallel with each other, and the anode and cathode protrusion portions 266*a* and 266*b* are symmetrical with respect to a central line of the second substrate 200. That is, each of the anode protrusion portions 266*a* faces each of the cathode protrusion portions 266*b*. When a discharge voltage is applied to the anode and cathode electrodes 260*a* and 260*b*, an electric charge is concentrated on edge portions of the anode and cathode protrusion portions 266*a* and 266*b*, so that the discharge occurs between the anode and cathode protrusion portions 266*a* and 266*b*. Thus, the density of the plasma is uniform. A dielectric layer 264 can be formed on the upper surfaces of the anode protrusion portions 266*a* and cathode protrusion portions 266*b*.

The plurality of barrier ribs 300 is disposed in the discharge space between the first and second substrates 100 and 200. Also, the barrier ribs 300 are disposed between the anode and cathode electrodes 260*a* and 260*b* and separated from each other in a predetermined distance. The barrier ribs 300 are extended in a direction perpendicular to the electrode 260, so that the barrier ribs 300 have a slender shape. The length of one barrier rib 300 corresponds to 80 to 90% of a width of the first substrate 100. Thus, the discharge space 400 is divided into a plurality of discharge areas by the barrier ribs 300.

The barrier ribs 300 are made of a glass having a proper level of light transmissivity and is fixed to either the lower surface of the first substrate 100 or the upper surface of the second substrate 200 with a light transmissible adhesive optionally having a dielectric. The barrier ribs 300 can have various forms depending on a shape of the flat type fluorescent lamp. A pair of protruding portions 266 comprised of one of anode protruding portions 266*a* and one of cathode protruding portions 266*b* is disposed between the barrier ribs 300. That is, the anode and cathode protruding portions 266*a* and 266*b* facing to each other are alternately disposed with the barrier ribs 300.

The barrier ribs 300 support the first substrate 100 to maintain an integrity of the flat type fluorescent lamp 900. The discharge space 400 of the flat type fluorescent lamp 900 has to be maintained in a low pressure close to a vacuum state to generate the visible ray. The barrier ribs 300 prevent the first substrate 100 from being sagged or broken due to a pressure difference between the inside and outside the discharge space, so that the flat type fluorescent lamp 900 can maintain an outward form in its integrity. The protruding portion 266 decreases a distance between the anode electrode 260*a* and the cathode electrode 260*b*, thus the discharge in the discharge space easily occurs. Also, since the electric charge is concentrated on the edge portions of the protruding portion 266, the discharge occurs in the divided discharge areas. Thus, it is able to prevent the brightness from being lowered due to concentration of the plasma on a certain region in the discharge space. During discharge, each of the divided discharge area is independently operated as a discharge space, thereby obtaining the plasma having a uniform density. The barrier ribs 300 include a second fluorescent layer 112. The second fluorescent layer 112 prevents generation of a shadow portion through the surfaces of the first and second substrate 100 and 200 corresponding to the flat type barrier ribs 300.

The discharge space 400 is isolated from an external of the flat type fluorescent lamp 900 by sealing side portions of the first and second substrates 100 and 200. An exhaust pipe (not shown) for making the discharge space in a vacuum state is disposed on the second substrate 200. After exhausting an air from the discharge space with a vacuum pump through the exhaust pipe, the discharge space is charged by the discharge gas such as a xenon, an argon, etc., therethrough. Then, the discharge space is completely isolated from the external by sealing the exhaust pipe.

When a discharge voltage is applied to the flat type fluorescent lamp 900, an electron is emitted from the cathode protruding portion 266*b* toward the anode protruding portion 266*a* and the electron excites the discharge gas to a plasma. The ultraviolet ray generated while the discharge gas is excited generates the visible ray by reacting with the first and second fluorescent layers 110 and 112, so that the flat type fluorescent lamp 900 is operated as a lamp. Since the discharge simultaneously occurs between the anode and cathode protruding portions 266*a* and 266*b* of each of divided discharge areas, the plasma is generated simultaneously throughout the discharge space divided into a plurality of discharge areas while the discharge occurs. Thus, the plasma and the visible ray generated by reacting the plasma with the first and second fluorescent layers 110 and 112 have a uniform density, and an amount of light emitted from the flat type fluorescent lamp 900 is constant.

Figure 5:
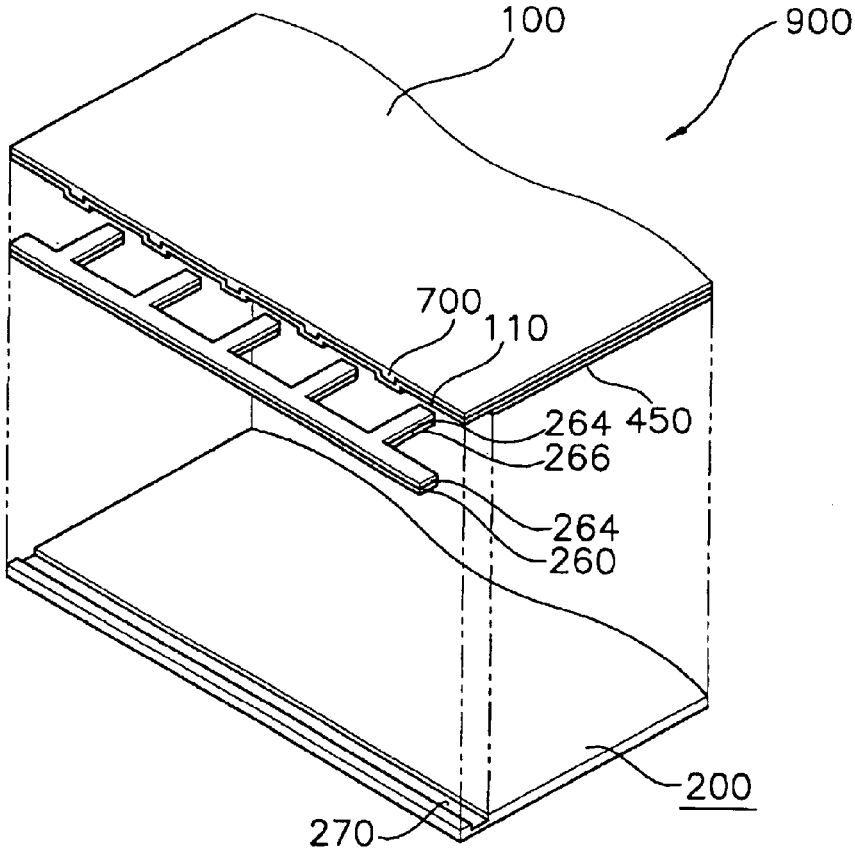
FIG. 5 is an exploded perspective view showing a structure of a flat type fluorescent lamp according to a second embodiment of the present invention.
Figure 6:
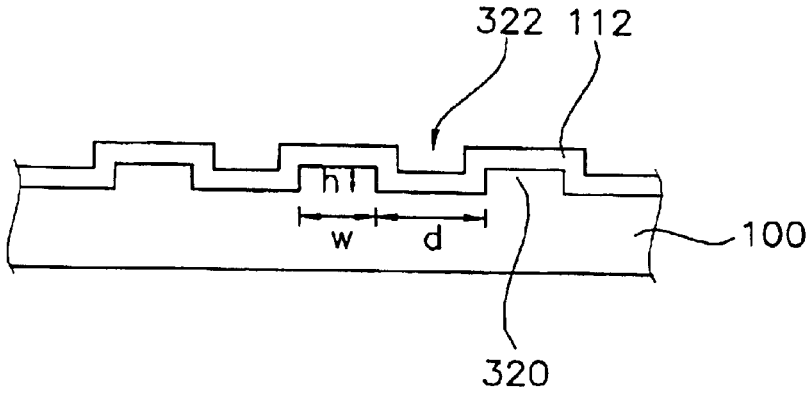
FIG. 6 is a cross sectional view taken along the line of $A_1$–$A_2$ for illustrating a structure of a first substrate of the flat type fluorescent lamp shown in FIG. 5.

FIG. 5 is an exploded perspective view showing a structure of a flat type fluorescent lamp according to a second embodiment of the present invention. FIG. 6 is a cross-sectional view taken along the line of $A_1$–$A_2$ for illustrating a structure of a first substrate. A flat type fluorescent lamp shown in FIG. 5 has a structure identical with that of a flat type fluorescent lamp shown in FIG. 3 except a barrier rib is integrally formed with a first substrate.

Referring to FIGS. 5 and 6, barrier ribs 320 having a predetermined width and height are disposed under a lower surface of the first substrate 100. The barrier ribs 320 are formed by partially removing the lower surface by spraying a compressed abrasive in a high pressure through a sand blast nozzle on the lower surface after positioning a mask for forming the barrier rib 320 on the lower surface of the first substrate 100. That is, portions of the lower surface of the first substrate 100 not removed by the compressed abrasive perform as the barrier ribs 320. Thus, the barrier ribs 320 have a height "h" corresponding to a depth of concaves 322 formed by the compressed abrasive. The barrier ribs 320 are separated from each other by a distance "d" corresponding to a width of the concaves 322 and each of the barrier ribs 320 has a width "w". The width "w" can be about from 1 to 2 mm. The barrier ribs 320 are disposed between the anode and cathode electrodes 260*a* and 260*b* and extended in a direction perpendicular to the electrode 260. The barrier ribs 320 have a length which is about from 80 to 90% of the width of the first substrate 100. The barrier ribs 320 can be formed using a grinding method, a photolithography and an etching method and so on.

Lower surfaces of the barrier ribs 320 are fixed to the upper surface of the second substrate 200 and spaces between the concaves 322 and the second substrate 200 are operated as a plurality of separate discharge areas. A pair of protruding portion 260 having anode and cathode protruding portions respectively extended from the anode and cathode electrodes 260*a* and 260*b* is arranged in each of the discharge areas. Also, the second fluorescent layer 112 is disposed on the barrier ribs 320, thereby preventing the brightness from being reduced by the barrier ribs 320. Since there is no need to use an adhesive between the barrier ribs 320 and the first substrate 100, it is able to prevent the brightness from being reduced and the light efficiency from being lowered by the adhesive.

Figure 7:
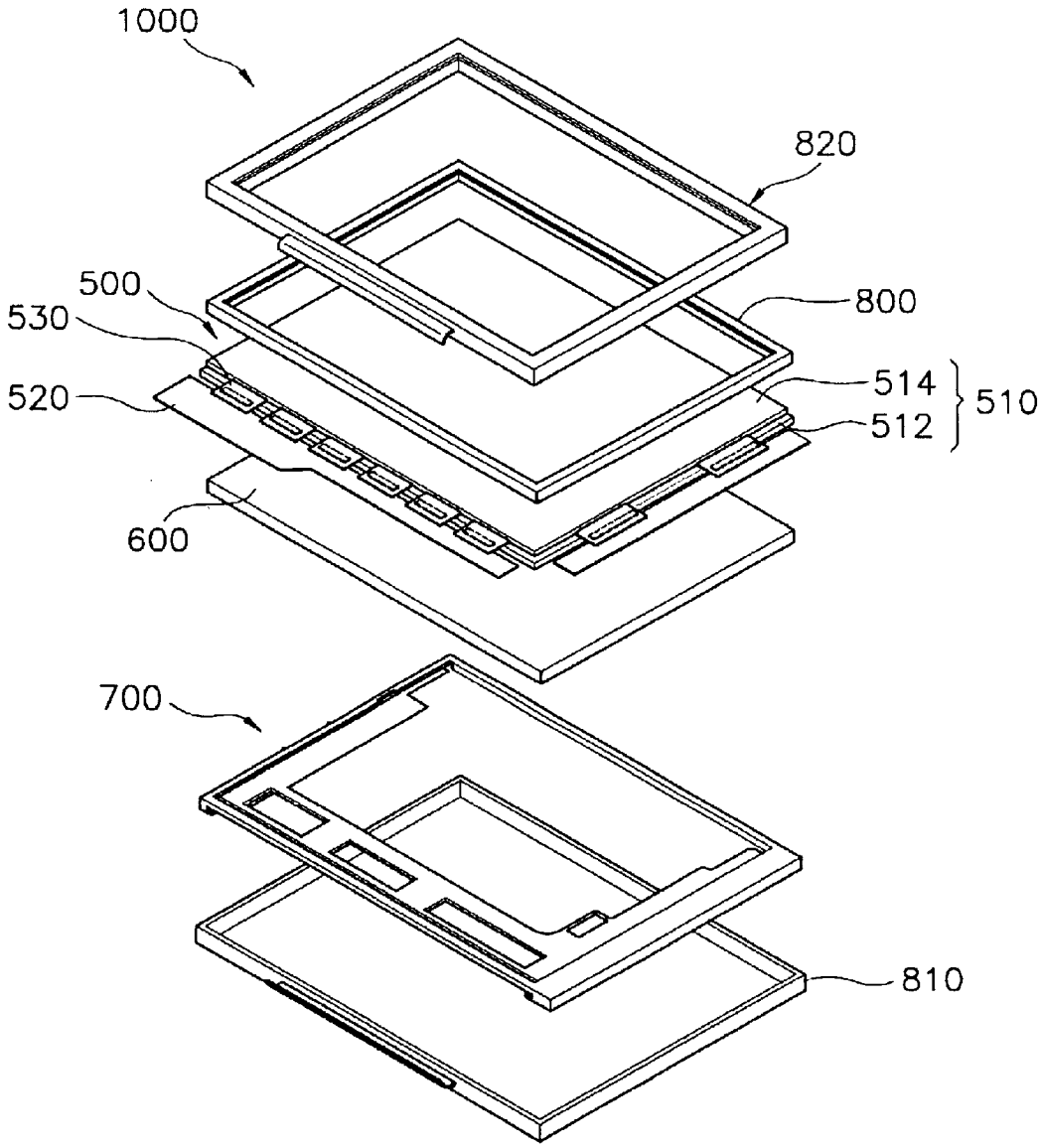
FIG. 7 is an exploded perspective view showing a structure of an LCD apparatus adopting the flat type fluorescent lamp shown in FIG. 5 as a backlight.

FIG. 7 is an exploded perspective view showing a structure of an LCD apparatus adopting the flat type fluorescent lamp shown in FIG. 5 as a backlight.

Referring to FIG. 7, the LCD apparatus 1000 includes a display unit 500 for receiving an image signal and displaying an image, a backlight 600 for emitting light and a receiving container 700 for receiving the display unit 500 and the backlight 600.

The display unit 500 includes an LCD panel 510 for displaying the image, a plurality of printed circuit boards (PCBs) 520 for supplying an image signal and controlling the image signal and a tape carrier package (TCP) 530. The LCD panel 510 includes a thin film transistor (TFT) substrate 512 that is a transparent glass substrate on which a plurality of TFTs are formed in a matrix form, a color filter substrate 514 including R, G, B color pixels formed thereon, for example, by a thin film process, for displaying colors and a liquid crystal (not shown) interposed between the TFT substrate 512 and the color filter substrate 514. The PCBs 520 provides a driving signal for controlling an aligning angle of the liquid crystal to the LCD panel 510 and the TCP 530 provides a timing signal for controlling an aligning timing of the liquid crystal to the LCD panel 510.

The backlight 600 for providing the light to the display unit 500 is disposed under the display unit 500. The backlight 600 uses the flat type fluorescent lamp 900 as shown in FIG. 5 as a surface discharging type light source. Thus, it is able to improve the light efficiency and reduce a number of parts and cost of the LCD apparatus by preventing the light from being lost by a light guide plate and an optical sheet. In a case where the barrier ribs 320 are integrally formed with the first substrate 100, a shadow portion due to an adhesive used to adhere the barrier ribs to the first substrate can be removed, thereby improving the image quality displayed through the LCD apparatus 1000.

Under the backlight 600, a reflection plate (not shown) for reflecting the visible ray emitted from the backlight 600 to the display unit 500 is disposed to reduce the light loss. The display unit 500 and the backlight 600 are received in a mold frame 700. A chassis 800 is provided above the display unit 500. The chassis 800 is coupled with the mold frame 700 so as to bend the PCB 520 towards an exterior of the mold frame 700 and prevent the display unit 500 from separating from the mold frame 700. The mold frame 700 coupled with the chassis 800 is received between a front case 820 and a rear case 810.

When the TFTs formed on the TFT substrate 512 are turned on, an electric field is generated between a pixel electrode of the TFT substrate 512 and a common electrode of the color filter substrate 514. The electric field varies the aligning angle of the liquid crystal injected between the TFT substrate 512 and the color filter substrate 514. Accordingly, the light transmission is varied according to the variation of the aligning angle of the liquid crystal, so a desired image can be obtained.

According to the present invention, the discharge space of the flat type fluorescent lamp is divided into a plurality of discharge areas, so that the plasma generated during discharge has a uniform density.

The barrier ribs that divide the discharge space into a plurality of discharge areas are integrally formed with the first substrate used as an upper substrate, thereby increasing the brightness and the uniformity of the light emitted from the flat type fluorescent lamp.

Since the LCD apparatus employs the flat type fluorescent lamp in which the discharge space is divided into a plurality of the discharge areas as the backlight, it is able to improve the light efficiency and reduce the number of parts and the cost of the LCD apparatus.

Also, when the barrier ribs are integrally formed with the upper substrate, it is able to prevent the shadow portion from appearing on a display surface, thereby improving the image quality displayed through the LCD apparatus.

Although the present invention have been described with reference to several embodiments thereof, it is understood that the present invention should not be limited to these embodiments but various changes and modifications can be made by one skilled in the art within the spirit and scope of the appended claims.

What is claimed is:

1. A flat type fluorescent lamp comprising:

a first substrate having a first fluorescent layer;

a second substrate disposed parallel with the first substrate;

a discharge space formed between the first and second substrates, and containing a discharge material;

an electrode part having first and second electrodes parallel to each other for applying a voltage to the discharge space, the first and second electrodes being disposed on the second substrate;

a plurality of barrier ribs disposed in the discharge space, the plurality of barrier ribs being perpendicular to the first and second electrodes and lower and upper surfaces of the plurality of barrier ribs respectively contacting an upper surface of the second substrate and a lower surface of the first substrate, the barrier ribs dividing the discharge space into a plurality of discharge areas;

a first projection portion extended from the first electrode toward the second electrode by a first length; and a second projection portion extended from the second electrode toward the first electrode by a second length, wherein the first and second projection portions are disposed in corresponding one of the discharge areas.

2. The flat type fluorescent lamp of claim 1, wherein the first projection portion and the second projection portion are disposed between adjacent ones of the barrier ribs, the first and second projection portions being apart from the barrier ribs at a selected distance.

3. The flat type fluorescent lamp of claim 1, further comprising a plurality of first projection portions protruded from the first electrode, and a plurality of second projection portions protruded from the second electrode, the plurality of first and second projection portions being parallel with the plurality of barrier ribs.

4. The flat type fluorescent lamp of claim 3, wherein the plurality of first and second projection portions and the plurality of barrier ribs are alternately disposed.

5. The flat type fluorescent lamp of claim 1, further comprising a dielectric layer on upper surfaces of the first and second electrodes, the upper surfaces of the first and second electrodes facing the lower surface of the first substrate.

6. The flat type fluorescent lamp of claim 1, further comprising a dielectric layer on upper surfaces of the first and second projection portions.

7. The flat type fluorescent lamp of claim 1, wherein the discharge material is a non-volatile gas.

8. The flat type fluorescent lamp of claim 1, wherein the plurality of barrier ribs are integrally formed on the lower surface of the first substrate such that the barrier ribs are integral protrusions of the first substrate.

9. The flat type fluorescent lamp of claim 8, further comprising a second fluorescent layer on entire surface of the plurality of barrier ribs.

10. The flat type fluorescent lamp of claim 1, further comprising a sealing member for sealing side portions of the first and second substrates and isolating the discharge space from a peripheral space thereof.

11. The flat type fluorescent lamp of claim 1, wherein the second substrate includes first and second grooves for respectively receiving the first and second electrodes.

12. The flat type fluorescent lamp of claim 11, wherein the first and second grooves have a depth less than a thickness of the first and second electrodes.

13. A liquid crystal display apparatus comprising:

a backlight assembly for generating a light;

a display unit for receiving the light emitted from the backlight assembly and controlling a liquid crystal to display an image; and a receiving container for sequentially receiving the backlight assembly and display unit;

wherein the backlight assembly comprises a flat type lamp including a first substrate having a first fluorescent layer; a second substrate disposed parallel with the first substrate; a discharge space formed between the first and second substrates, and containing a discharge material; an electrode part having first and second electrodes parallel to each other for applying a voltage to the discharge space, the first and second electrodes being disposed on the second substrate; a plurality of barrier ribs disposed in the discharge space, the plurality of barrier ribs being perpendicular to the first and second electrodes and lower and upper surfaces of the plurality of barrier ribs respectively contacting an upper surface of the second substrate and a lower surface of the first substrate, the barrier ribs dividing the discharge space into a plurality of discharge areas; a first projection portion extended from the first electrode toward the second electrode by a first length; and a second projection portion extended from the second electrode toward the first electrode by a second length, wherein the first and second projection portions are disposed in corresponding one of the discharge areas.

14. The liquid crystal display apparatus of claim 13, wherein the first projection portion and the second projection portion are disposed between adjacent ones of the barrier ribs, the first and second projection portions being apart from the barrier ribs at a selected distance.

15. The liquid crystal display apparatus of claim 13, further comprising a plurality of first projection portions protruded from the first electrode, and a plurality of second projection portions protruded from the second electrode, the plurality of first and second projection portions being parallel with the plurality of barrier ribs.

16. The liquid crystal display apparatus of claim 15, wherein the plurality of first and second projection portions and the plurality of barrier ribs are alternately disposed.

17. The liquid crystal display apparatus of claim 13, wherein the plurality of barrier ribs are integrally formed on the lower surface of the first substrate such that the barrier ribs are integral protrusions of the first substrate.

18. The liquid crystal display apparatus of claim 17, further comprising a second fluorescent layer formed on entire surface of the plurality of barrier ribs.

19. The liquid crystal display apparatus of claim 13, further comprising a sealing member for sealing side portions of the first and second substrates and isolating the discharge space from a peripheral space thereof.

20. The liquid crystal display apparatus of claim 13, wherein the second substrate includes first and second grooves for respectively receiving the first and second electrodes.

21. The liquid crystal display apparatus of claim 20, wherein the first and second grooves have a depth less than a thickness of the first and second electrodes.

22. The flat type fluorescent lamp of claim 1, wherein the barrier ribs each have an upper surface facing the lower surface of the first substrate, a second fluorescent layer being formed on the upper surface of the respective barrier ribs.

23. The flat type fluorescent lamp of claim 22, wherein the barrier ribs are made of material having light transmissivity.

24. The flat type fluorescent lamp of claim 1, wherein the barrier ribs each have first and second longitudinal end portions adjacent to the first and second electrodes, respectively, the first and second longitudinal end portions being apart from the first and second electrodes, respectively, at a selected distance.

* * * * *

UNITED STATES PATENT AND TRADEMARK OFFICE

CERTIFICATE OF CORRECTION

PATENT NO. : 6,787,981 B2
APPLICATION NO. : 10/213688
DATED : September 7, 2004
INVENTOR(S) : Hyeong-Suk Yoo et al.

It is certified that error appears in the above-identified patent and that said Letters Patent is hereby corrected as shown below:

Title Page:
Item (73) Assignee, delete "(JP)" and insert therefor -- (KR) --.
Item (57) Abstract, line 15 after "density" delete "through out" and insert therefor -- throughout --.

Column 2:
Line, 33, after "and" delete "b" and insert therefor -- 26b --.

Column 6:
Line 53, after "protruding" delete "portion" and insert therefor -- portions --.

Column 8:
Line 3, after "invention" delete "have" and insert therefor -- has --.

Signed and Sealed this

Eighth Day of May, 2007

JON W. DUDAS
*Director of the United States Patent and Trademark Office*